US005190504A

United States Patent [19]

Scatterday

[11] Patent Number: 5,190,504

[45] Date of Patent: Mar. 2, 1993

[54] DEFORMABLE GRIP

[76] Inventor: Mark A. Scatterday, 4001 N. 54th Pl., Phoenix, Ariz. 85018

[21] Appl. No.: 895,791

[22] Filed: Jun. 9, 1992

[51] Int. Cl.[5] ..... A63B 23/16

[52] U.S. Cl. ..... 482/49; 273/58 H

[58] Field of Search ..... 482/22, 49, 50, 20, 482/44, 148; 273/58 F, 58 H; 446/267, 369

[56] References Cited

U.S. PATENT DOCUMENTS

| | | | |
|---|---|---|---|
| 3,347,545 | 10/1967 | Nichols | 446/267 |
| 3,601,923 | 8/1971 | Rosenberg | 446/267 |
| 3,748,779 | 7/1973 | Cherk et al. | 446/369 |
| 3,977,121 | 8/1976 | Goldfarb et al. | 446/369 |
| 4,952,190 | 8/1990 | Tarnoff et al. | 273/58 H |

*Primary Examiner*—Stephen R. Crow
*Attorney, Agent, or Firm*—Schmeiser, Morelle & Watts

[57] ABSTRACT

The invention is a semi-resilient exercise grip that has a non-resilient particulate core surrounded by a resilient rubber covering. Within the core there is also a dry lubricant such as talc that allows the particles to move over each other without damage. The outer covering may consist of a single thick latex layer, a thin latex layer surrounded by a thick rubber layer or a number of thin latex layers. The semi-resiliency of the grip enables a user to deform the grip and thereby change its shape. The grip can be moved within the hand to allow the user to deform it repeatedly while changing the grip's shape each time.

8 Claims, 2 Drawing Sheets

DEFORMABLE GRIP

FIELD OF THE INVENTION

The invention is in the field of exercising equipment. More particularly, the invention is a grip designed to be squeezed by a user's hand to thereby improve the strength of the user's hand, wrist and forearm. The grip has a semi-resilient structure in that once it is compressed by a user and undergoes a major deformation, it only partially returns to its former shape.

BACKGROUND OF THE INVENTION

In the exercise field, there are numerous devices designed to help a user improve his or her grip strength and the muscles of the wrist and forearm. These devices usually can be classified in one of two categories. In the first category is the type of device that fits within a user's hand and is squeezed by the user. In the second category is the type of hand exerciser that has one or more springs or elastic bands attached to a base. In the latter type of device, the user attempts to stretch the springs/bands with his or her fingers.

The squeezable type of device is typified by a ball or an ergonomically-shaped grip that the user can hold within a hand. Common rubber balls have been used as exercise grips for many years with varied amounts of success. The ergonomically-shaped grips normally include a shaped body that has indentations along a forward edge to partially receive each of a user's long fingers.

The squeezable grips are manufactured from a rubber material that is fully resilient. The inherent resiliency of the material causes the grip to fully recover its original shape after being deformed by the user's hand. Once the user has the grip within his or her hand, the user exercises by repeatedly squeezing and then releasing the grip. While exercising, the grip is normally maintained in a single position without any rotation caused by the user's fingers.

The second type of exercise device normally includes a rigid, elongated base and a plurality of spacedly attached springs or elastic bands that are individually connected to the fingers of one of the user's hands. The user places his or her hand onto the device and uses his or her fingertips to stretch the springs or elastic bands. When the user stops applying force, the springs or elastic bands return to their original length.

SUMMARY OF THE INVENTION

The invention is a ball-like grip that the user holds within one hand. The user applies pressure to the grip with his or her fingers to deform the grip's shape. The grip has a structure that makes it semi-resilient in that when the user stops applying pressure to the grip after it has been significantly deformed, it only partially returns to the shape it had prior to the deformation.

To achieve this semi-resilient characteristic, the grip employs a particulate core surrounded by a resilient rubber covering. The core is comprised of a quantity of free particles intermixed with a dry lubricant powder. The lubricant allows the particles to slide over one another without damage and helps to reduce the internal resistance to sliding movement within the core.

The rubber covering exterior to the core is made of a latex rubber material that has a round shape when in an undeformed state. Whenever the core is deformed from a round shape, the rubber covering is stretched. When the deforming forces are released, the covering attempts to reshape the core back to a round shape. If the deformation has been considerable, the resiliency of the covering cannot fully overcome the core's resistance to deformation. As a result, the grip only partially recovers its previous shape.

The semi-resilient characteristic of the grip significantly enhances its use. When the user initially compresses the grip, it will change its shape from a round ball to a disc-like shape. Once the user stops squeezing the grip, it partially springs back to its pre-deformation shape and becomes substantially egg-shaped. The new shape somewhat conforms to the shape of the user's hand. At this point, the longitudinal axis of the grip extends across the user's palm and is substantially perpendicular to the longitudinal axis of the user's forearm.

The user can repeat the above exercise and again cause the grip to deform into a disc shape. When the user stops squeezing the grip, it will substantially return to the egg shape it had prior to the latest deformation. However, once the grip has been deformed and is egg-shaped, the user will normally rotate the grip ninety degrees so that its longitudinal axis is substantially parallel to the longitudinal axis of the user's forearm. The user then squeezes the grip until it again assumes a disc shape. Upon release, it again assumes an egg shape that somewhat conforms to the user's hand. The user may then rotate the grip another ninety degrees and repeat the squeezing motion.

The invention, by retaining some of the deformation caused by the user's gripping action, lends itself to the manual manipulation described above. The user can, with every compression, change the shape of the grip. When the grip has become egg-shaped and is rotated, the grip no longer substantially conforms to the shape of the user's palm and the user can again apply a compressive force to reshape the grip.

By providing a grip that is deformable and semi-resilient, the grip is more enjoyable and challenging to use than the grips or the base-secured hand exercisers of the prior art.

DETAILED DESCRIPTION OF THE DRAWINGS

Figure 1:
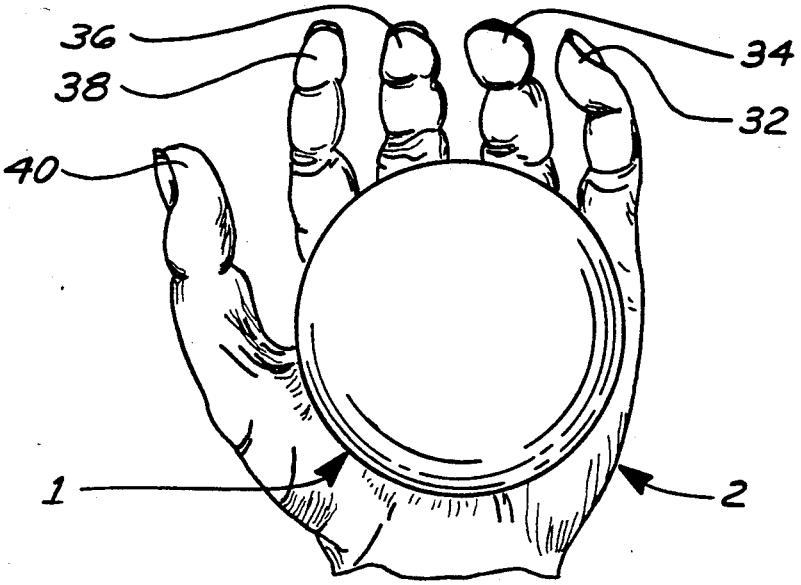
FIG. 1 is a perspective view of the invention being held in a user's hand.

Referring now to the drawings in greater detail, wherein like reference characters refer to like parts throughout the several figures, there is shown by the numeral 1 a grip in accordance with the invention being held by a user's hand 2.

In a non-deformed state, the grip has a shape similar to that of a ball. It is sized to comfortably fit a user's palm and weighs from three to five ounces.

Figure 5:
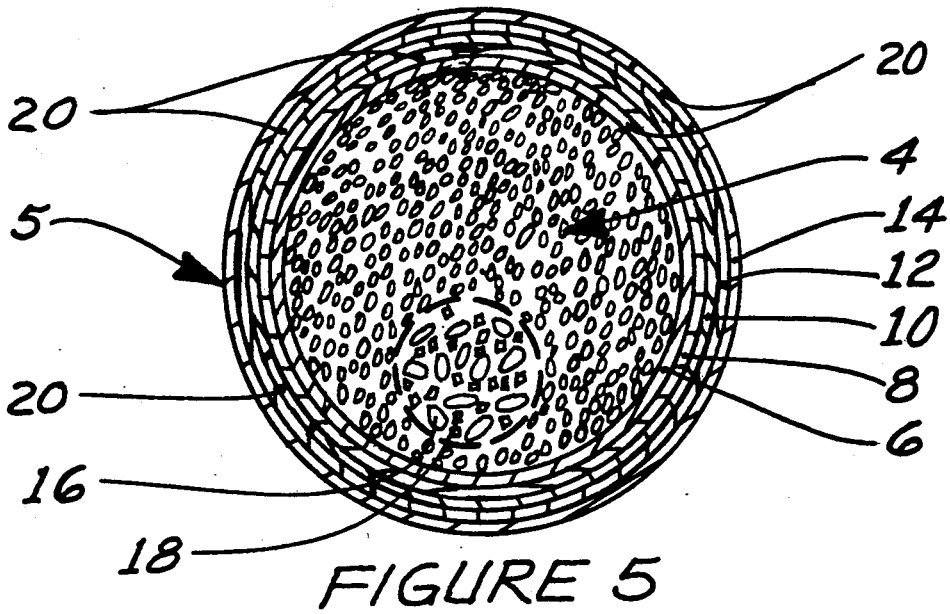
FIG. 5 is a cross-sectional view of the invention shown in FIG. 1 and also shows a magnified view of a portion of the core.

FIG. 5 provides a cross-sectional view of the grip in which the interior of the grip is detailed. As can be seen, the grip includes a core 4 that is surrounded by a covering 5 comprised of a plurality of latex layers 6, 8, 10, 12 and 14.

The core of the grip is basically non-resilient and is formed from a dense packing of loose particles 16. In practice, seeds such as millet have been used as the particles. As an alternative, the particulate material can be hard plastic or silicon beads or any other matter that is similar in size and shape to millet and that is hard enough to withstand the compressive pressures experienced when the grip is being squeezed by a user.

Mixed in with the particulate material is a powder-type dry lubricant 18 such as talc. This combination of materials allows the relatively small particles to slide over each other without damage or excessive amounts of friction.

Each of the latex layers 6–14 are very thin and are round in shape when in an undeformed state. Prior to receiving the core, each layer is similar to a round balloon prior to its being filled with air. As the core is inserted, the latex layer stretches but tends to maintain the round shape it had when in an unstretched condition. To allow for the insertion of the core, each latex layer includes a single hole 20. The exterior surface of the covering may be textured to facilitate the grasping of the grip and to improve user comfort.

To construct the grip, the particulate material and lubricant that make up the core are initially inserted through hole 20 of the first latex layer 6. The entering material stretches the latex layer in a manner similar to when water is forced into a balloon to make a water balloon. Sufficient material is inserted to create a round, tightly-packed core that has a diameter of approximately two and one-half inches. Once the first latex layer has been filled, the single wrapped (by layer 6) core is then inserted through hole 20 of the second layer 8 thereby causing it to stretch to a similar diameter. During the latter insertion process, the hole 20 in the layer 6 is located so that it is spaced approximately ninety to one-hundred-eighty degrees apart from the hole in the encircling layer 8. This procedure is then repeated with the remaining layers until the grip's core is enveloped by five layers of the latex material. Once the core has been inserted within the final layer, glue is placed around the perimeter of hole 20 of layer 14 to fix the latex surrounding the hole to the underlying layer.

It should be noted that in receiving the core, each succeeding latex layer is stretched, thereby causing a constant inward force to be exerted on the core by the latex layers. In this manner, the latex layers urge the grip to assume a round shape since each individual latex layer was originally round.

In an alternate mode of manufacture, the core material is first placed within a round rubber sack similar to layer 6. The enveloped core is then dipped into molten rubber to thereby form an outer resilient layer that does not have an opening 20.

In another alternate mode of manufacture, the core can be received within a single, thick latex covering that is then plugged to prevent the escape of the core material. The covering is resilient and is round in an undeformed state.

The combination of a resilient covering and a non-resilient core provides the invention with unique characteristics and capabilities not found in the prior art. When the grip is initially deformed by a user's hand, the user must overcome the core's resistance to deformation and cause the resilient covering to stretch. When the user ceases compressing the grip, the latex layers exert pressure on the core as they try to resume a round shape. If the deformation is significant, the pressure will be insufficient to fully overcome the tendency of the core material to remain deformed. As a result, the grip will only partially return to the shape it had prior to the deformation. In this manner, the grip is semi-resilient.

In practice, after the grip has experienced a significant deformation (where any of its dimensions have been changed by more than approximately ten percent), the grip will return to approximately fifty to ninety percent of its pre-deformation shape.

It should be noted that if the core is already in a deformed shape, repetitive deformations without re-orienting the grip will not cause the grip to significantly change its initial deformed shape upon the release of pressure. This is due to the fact that the spring constant of the latex covering 5 causes the effort required to stretch the latex to increase as the latex is stretched. As a result, the force exerted on the core by the covering increases proportionally. For example, once the grip has become disc shaped, it becomes increasingly difficult to further flatten the disc.

The inherent properties of the grip due to its structure enable it to be used in a manner that is different from the prior art and that is both interesting and challenging. An example of how the grip may be used is provided in FIGS. 1–4 in which four consecutive stages of use are shown.

The invention can be used by either a male or female user. To simplify the descriptions of use, a male user will be described.

In FIG. 1, the grip 1 is shown prior to deformation and as such, it has a substantially round, ball-like shape. It is being held in a user's hand 2 atop the palm portion 20 of the hand. The user's long fingers 32, 34, 36 and 38 and thumb 40 are not exerting any compressive pressure on the grip.

Figure 2:
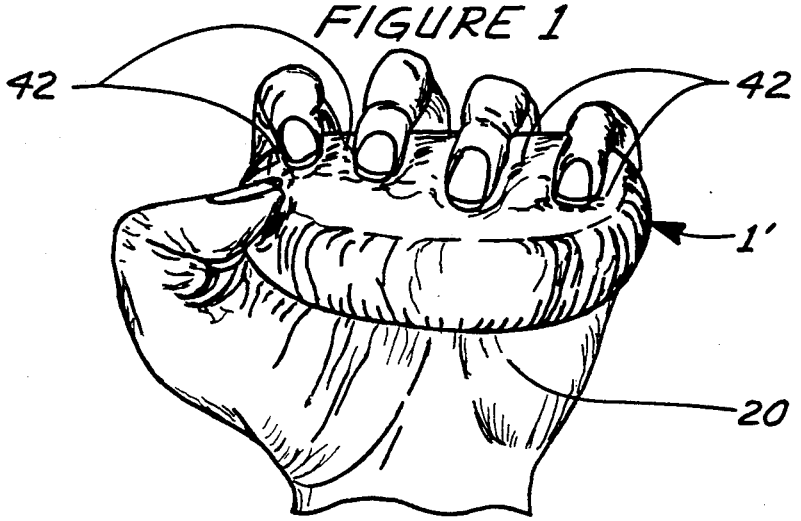
FIG. 2 is a perspective view of the invention shown in FIG. 1 being squeezed by the hand.

FIG. 2 shows the grip at a point when the user has deformed its shape using his fingers and palm. The grip 1 has become compressed into a disc shape (labeled 1') and depressions 42 have been formed on its surface that partially receive/surround the contacting portions of the user's fingers. At the stage shown, the user is still exerting a compressive pressure on the grip with his hand.

Figure 3:
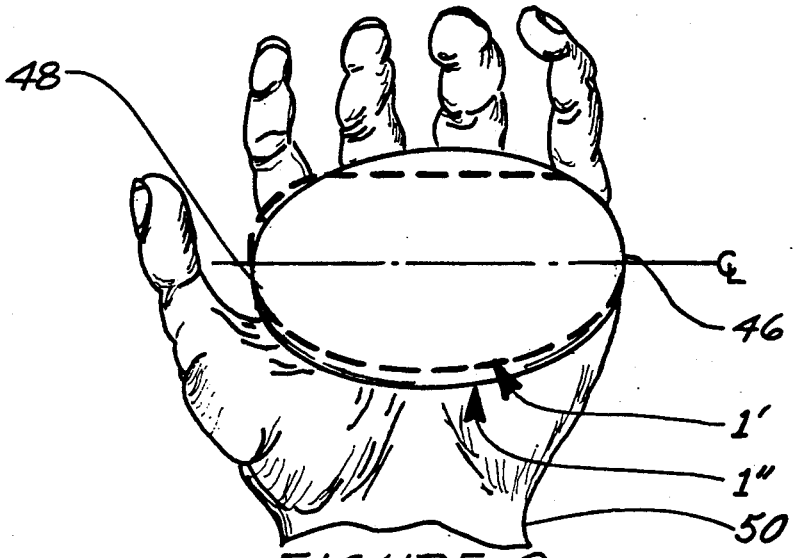
FIG. 3 is a perspective view of the invention of FIG. 1 after the compression shown in FIG. 2 has ceased.

FIG. 3 shows the next stage wherein the user has relaxed his hand and is no longer exerting compressive forces on the grip. The grip 1, upon the release of the compressive pressure, partially springs back to its original shape. As a result, the grip (labeled 1" in FIG. 3) assumes a shape similar to an egg and rests atop the user's palm with its ends 46 and 48 located on opposite sides of the palm and its longitudinal axis being substantially perpendicular to the longitudinal axis of the user's forearm 50. In the figure, the grip as deformed in FIG. 2 is shown in phantom. In this manner, one can see that the grip has only partially recovered its original round shape.

Figure 4:
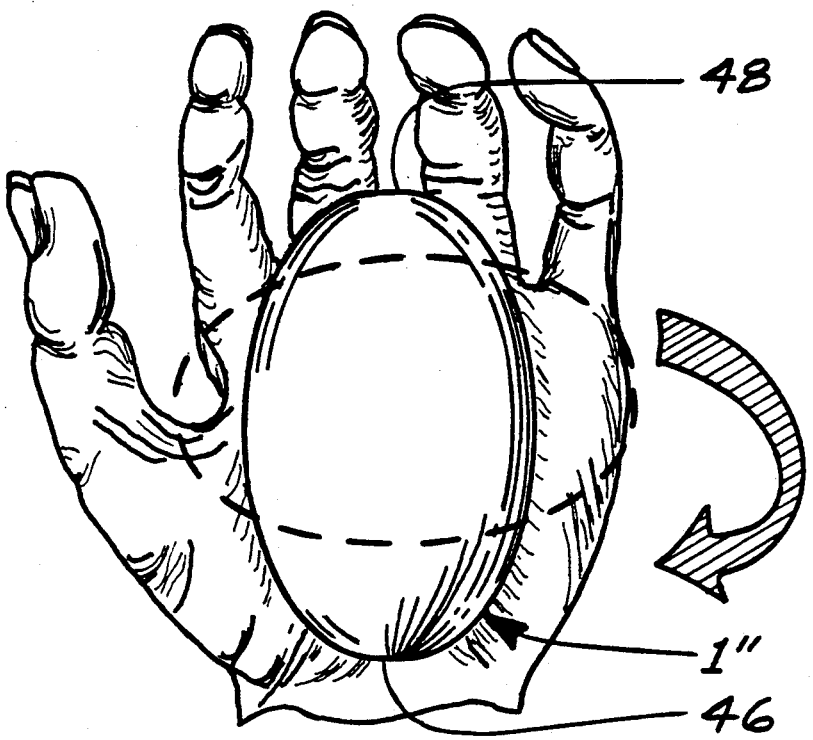
FIG. 4 is a perspective view of the invention of FIG. 1 after the deformed grip shown in FIG. 3 has been rotated ninety degrees.

In FIG. 4, the next stage of use is shown. A user will normally manually manipulate the grip with his fingers and rotate the grip ninety degrees. The ends of the grip are now located with end 46 proximate the user's wrist and end 48 proximate the base of the user's long fingers. At this point, the longitudinal axis of the grip is substantially parallel to the longitudinal axis of the user's forearm. The user can now apply compressive pressure to the grip with his hand and again mold it to fit his hand wherein the grip assumes the shape shown in FIG. 3 (shown in phantom in FIG. 4). By rotating the grip between compressions, the user significantly changes the shape of the grip with each compressive movement.

The semi-resiliency of the grip enables the user to remold the grip into an egg or disc shape and maintain the partial deformation until the next compression by the user. By rotating the grip ninety degrees, the user again has the situation where he can use his hand to re-mold the grip to conform to his hand.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A semi-resilient exercise grip comprising:

a non-resilient core containing a deformable mixture of individual particles identical in size and shape to millet and a talc lubricant; and a resilient covering surrounding said core wherein when the grip is held in a user's hand in a non-deformed round shape and then compressed by a user's hand, it is deformed into a first shape and upon the release of compressive force, the grip partially resumes the shape it had prior to the deformation and assumes a second shape.

2. The grip of claim 1 wherein the particles are tightly packed and are free to move within the core and the lubricant allows the particles to slide over each other without significant damage.

3. The grip of claim 1 wherein the particles are millet.

4. The grip of claim 1 wherein the lubricant is powdered talc.

5. The grip of claim 1 wherein the covering is formed from a plurality of rubber layers that are ball-shaped when in an unstretched state.

6. The grip of claim 5 wherein each rubber layer is formed from a latex rubber material.

7. A semi-resilient exercise grip consisting essentially of:

a core containing a deformable mixture of loose individual millet-sized and shaped particles and a dry talc lubricant; and a resilient rubber covering surrounding said core wherein when the grip is held in a user's hand in a non-deformed state, the grip has a round shape and wherein when the grip is compressed by a user's hand, it deforms into a first shape and upon the release of compressive force, the grip partially resumes the shape it had prior to the deformation and assumes a second shape.

8. The grip of claim 7 wherein the rubber covering is composed of a plurality of latex sacks and wherein each sack has a round shape when in an unstretched state.

* * * * *